US011723480B2

(12) United States Patent
Johnson et al.

(10) Patent No.: US 11,723,480 B2
(45) Date of Patent: Aug. 15, 2023

(54) SELF-CHECKOUT SYSTEM

(71) Applicant: Target Brands, Inc., Minneapolis, MN (US)

(72) Inventors: Jason W. Johnson, Wayzata, MN (US); Alex K. Poniatowski, Brooklyn Park, MN (US); Tyler M. J. Holm, Omaha, NE (US); Ben W. O'Brien, Omaha, NE (US); Chris I. Hellstrom, Papillio, NE (US); Tim F. Gargano, Omaha, NE (US); David A. Gnuse, Omaha, NE (US); Marian H. Locke, Parker, CO (US); Christopher P. Doepke, Spring Branch, TX (US); Matthew D. Purrington, Cottage Grove, MN (US); Robert A. Derk, Frisco, TX (US); Shifath Ikram Khan, Frisco, TX (US); Jorge S. Noyola, Frisco, TX (US); C. Matthew Ramon, Frisco, TX (US); Richard K. Steele, Frisco, TX (US); Thomas D. Karol, Frisco, TX (US)

(73) Assignee: Target Brands, Inc., Minneapolis, MN (US)

( * ) Notice: Subject to any disclaimer, the term of this patent is extended or adjusted under 35 U.S.C. 154(b) by 121 days.

(21) Appl. No.: 17/393,556

(22) Filed: Aug. 4, 2021

(65) Prior Publication Data

US 2023/0038835 A1 Feb. 9, 2023

(51) Int. Cl.

| | |
|---|---|
| ***A47F 9/04*** | (2006.01) |
| ***A47B 88/944*** | (2017.01) |
| ***A47B 88/40*** | (2017.01) |

(52) U.S. Cl.
CPC ..... *A47F 9/047* (2013.01); *A47B 88/40* (2017.01); *A47B 88/944* (2017.01)

(58) Field of Classification Search
CPC ..... A47F 9/047; A47B 88/40; A47B 88/944
See application file for complete search history.

(56) References Cited

U.S. PATENT DOCUMENTS

| | | | | |
|---|---|---|---|---|
| D558,481 | S | 1/2008 | Dias | |
| D648,953 | S | 11/2011 | Kruse | |
| 8,321,340 | B2 | 11/2012 | Garcia-Verona et al. | |
| 8,924,258 | B2 * | 12/2014 | Knoll | G06Q 20/209 705/16 |

(Continued)

FOREIGN PATENT DOCUMENTS

JP H09305826 A * 11/1997

OTHER PUBLICATIONS

U.S. Appl. No. 29/802,281 filed Aug. 4, 2021 for "Self-Checkout System", 6 pages.

*Primary Examiner* — Sonji N Johnson
(74) *Attorney, Agent, or Firm* — Leanne Taveggia Farrell; Westman, Champlin & Koehler, P.A.

(57) ABSTRACT

A self-checkout system including a cabinet supported by a floor, a tilt body coupled to a hinge and located inside the cabinet and a support body being slidably coupled to the tilt body. When the support body is located inside the cabinet, the tilt body is balanced about the hinge and the support body is spaced apart from the floor. When the support body is pulled outside the cabinet, a front of the tilt body is rotated about the hinge and the support body engages with the floor.

19 Claims, 14 Drawing Sheets

(56) References Cited

U.S. PATENT DOCUMENTS

| | | | | |
|---|---|---|---|---|
| D751,325 | S | 3/2016 | Catoe | |
| D828,348 | S | 9/2018 | Lee et al. | |
| 10,225,944 | B2 | 3/2019 | Rohan et al. | |
| 2008/0164279 | A1* | 7/2008 | Chirnomas | G07F 11/04 221/123 |
| 2012/0156976 | A1* | 6/2012 | Blake | G07D 3/128 453/4 |
| 2017/0308876 | A1 | 10/2017 | Inglis et al. | |

* cited by examiner

SELF-CHECKOUT SYSTEM

BACKGROUND

Self-checkouts (SCOs) are compact autonomous systems that include machines to optimize the checkout process by allowing a guest or customer in the retail store to complete their own transaction. Using a SCO, the guest or customer scans their items, places the items in a bag and pays for their total purchased items without needing one-to-one staff assistance.

The discussion above is merely provided for general background information and is not intended to be used as an aid in determining the scope of the claimed subject matter. The claimed subject matter is not limited to implementations that solve any or all disadvantages noted in the background.

SUMMARY

A self-checkout system includes a cabinet supported by a floor and configured to support externally located machines and internally located machines. The self-checkout system further includes a tilt body coupled to a hinge and a cartridge configured to support at least one of the internally located machines and including a pair of wheels. Drawer slides couplie the at least one cartridge to the tilt body. When the cartridge is in an unextended configuration, the tilt body is nested inside the cartridge and the cartridge is spaced apart from the floor. When the cartridge is in an extended configuration, the cartridge is pulled out from the tilt body, the tilt body pivots forward about the hinge and the pair of wheels of the cartridge engage with the floor.

A self-checkout system includes a cabinet supported by a floor, a tilt body coupled to a hinge and located inside the cabinet and a support body slidably coupled to the tilt body. When the support body is located inside the cabinet, the tilt body is balanced about the hinge and the support body is spaced apart from the floor, and when the support body is pulled outside the cabinet, a front of the tilt body is rotated about the hinge and the support body engages with the floor.

A self-checkout system comprising includes a cabinet having at least one front door and configured to be supported by a floor. The self-checkout system further includes a tilt body located inside the cabinet and being rotatably coupled to a hinge and a pullout cartridge slidably coupled to the tilt body and being located inside of and latched to the tilt body in a stored configuration and being located outside of and unlatched from the tilt body in an accessible configuration. In the stored configuration, the at least one front door is closed, the tilt body is nested inside the pullout cartridge and the pullout cartridge is spaced apart from the floor. In the accessible configuration, the at least one front door is opened, the tilt body is rotated forward about the hinge and the pullout cartridge is engaged with the floor.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

DETAILED DESCRIPTION

A self-checkout system is a self-contained transaction unit having at least a monitor, a flatbed scanner, a payment processing device, a coin machine and a bill/note machine. To improve the maintenance of and installation of the self-checkout system, the self-checkout system described below includes a secure exterior door and a secure interior door, a pivotal pull-out cartridge that supports one or more internal machines and a catch pan configured to protect the internal machines from accidental liquid spills.

Figure 1:
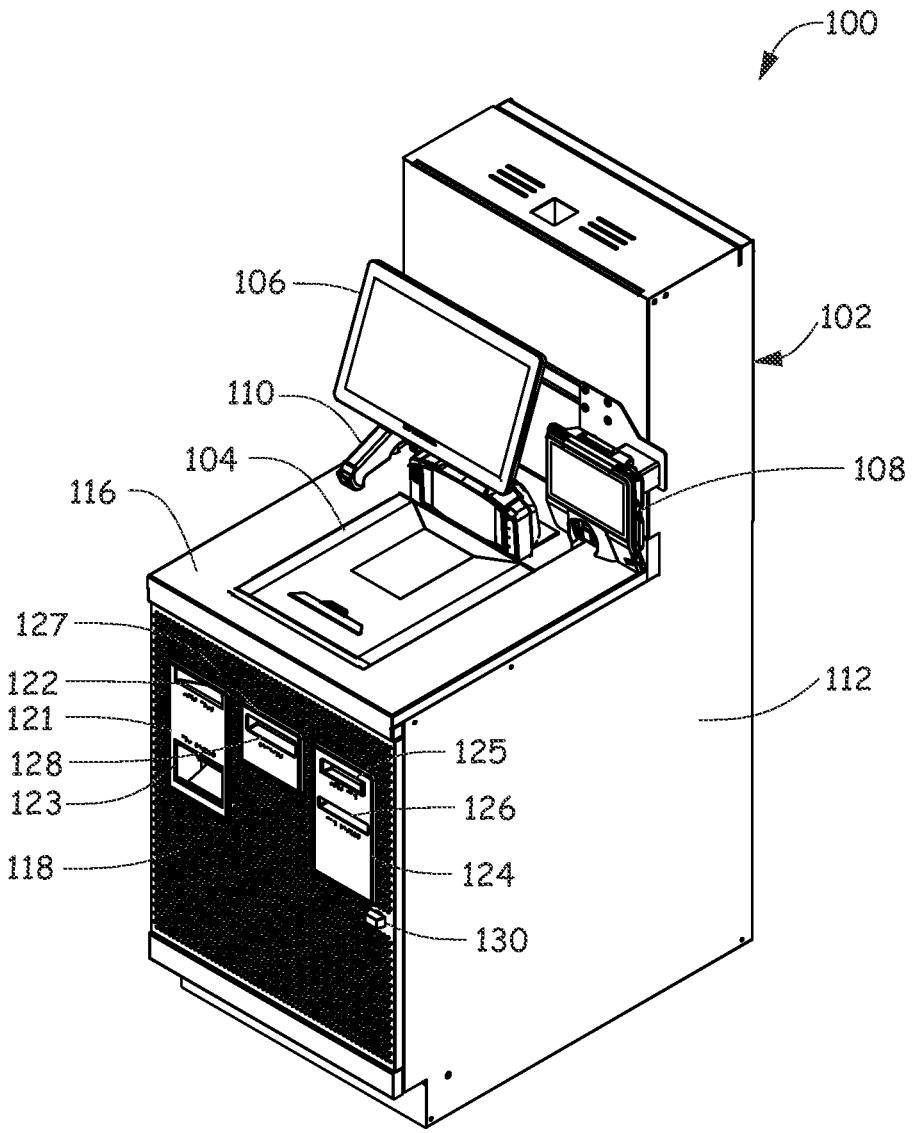
FIG. 1 illustrates a perspective view of a self-checkout system according to an embodiment.
Figure 2:
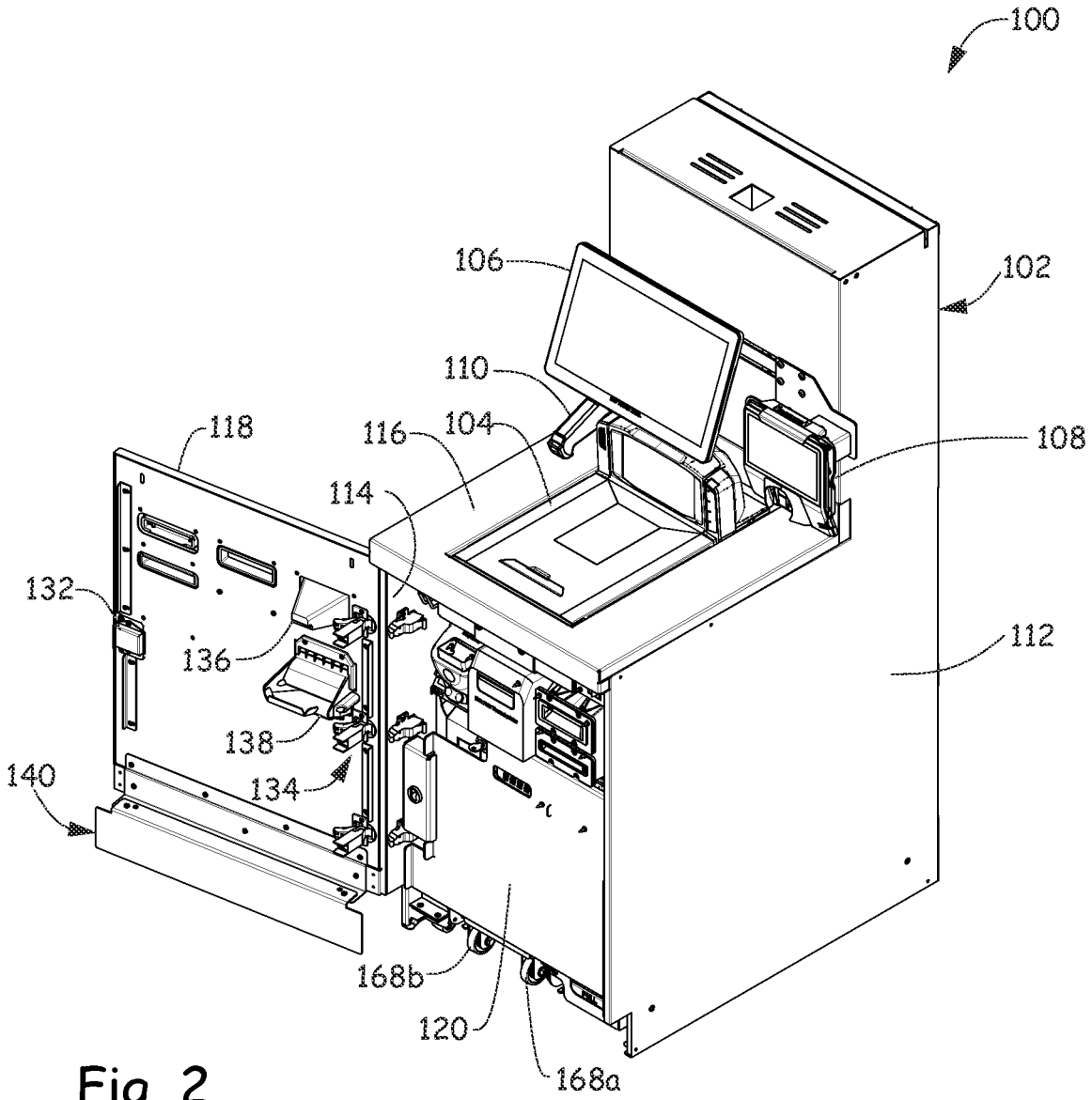
FIG. 2 illustrates a perspective view of the self-checkout system of FIG. 1 with a front exterior door of a cabinet opened.

FIG. 1 illustrates a perspective view of a self-checkout system according to an embodiment. Self-checkout system 100 includes a cabinet 102 supported by a floor and configured to house a plurality of internally located machines and externally located machines. Cabinet 102 includes a right side 112, an opposing left side 114 (FIG. 2), a top 116, a front exterior door 118 and a front interior door 120 (FIG. 2). External machines include a flatbed scanner 104, a monitor 106, a payment device 108 and a handheld scanner 110.

Figure 3:
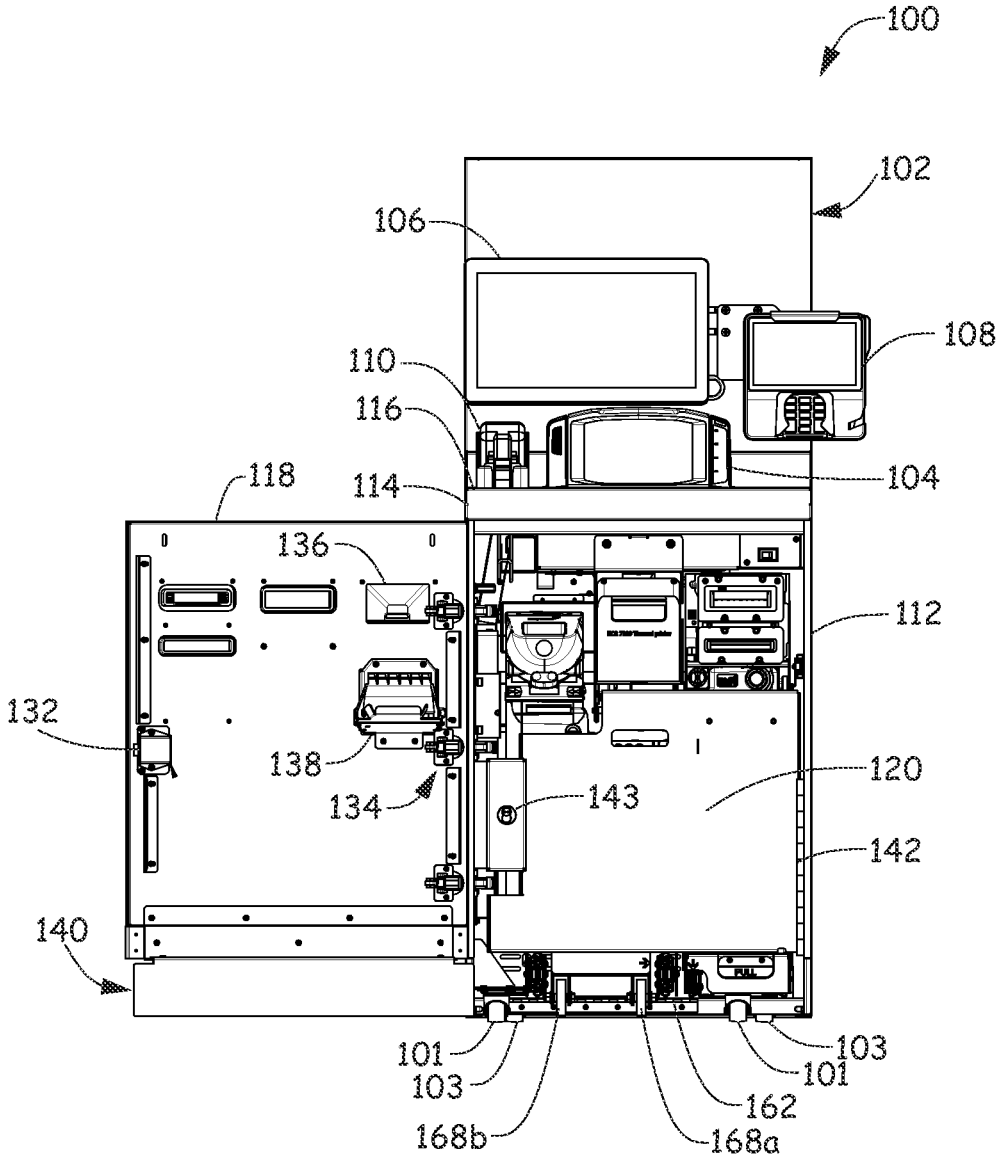
FIG. 3 illustrates a front view of FIG. 2.
Figure 4:
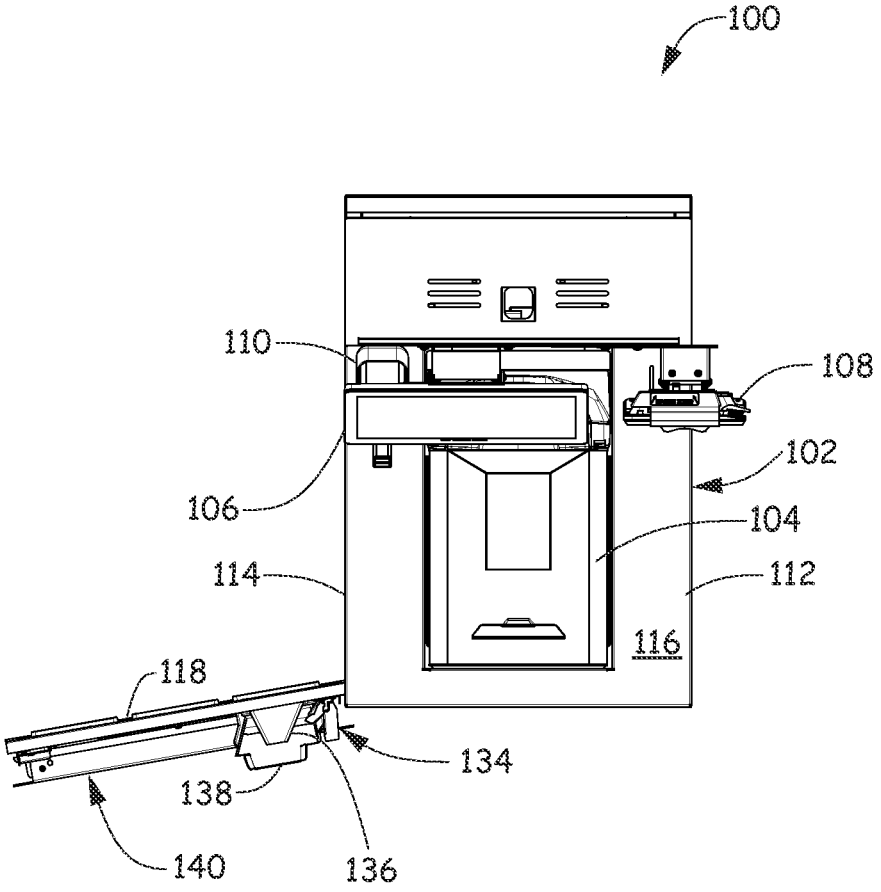
FIG. 4 illustrates a top view of FIG. 2

FIG. 2 illustrates a perspective view of self-checkout system 100 with exterior front door 118 of cabinet 102 in an opened position or configuration. FIG. 3 illustrates a front view and FIG. 4 illustrates a top view of FIG. 2. To configure self-checkout system 100 in a retail store, cabinet 102 is supported on casters 101 (FIG. 3) and cabinet 102 is pushed, wheeled or otherwise moved to a desired location in the retail store. Once cabinet 102 is placed in the appropriate location, feet or levelers 103 (FIG. 3) are extended to engage with the floor to set the position of cabinet 102 and to ensure that cabinet 102 is level regardless of how unlevel the floor.

As illustrated, front exterior door 118 is configured to cover an entirety of a front opening of cabinet 102. While front exterior door 18 is rotatably coupled to left side 114 by a hinge 134 or similar mechanism, front exterior door 118 may be in the alterative rotatably coupled to right side 114.

As illustrated in the figures, hinge 134 is a euro hinge where the mounting plates of the hinge are mounted to the interior side of left side 114 and the interior side of front exterior door 118. Euro hinges allow the hinges to be concealed when door 118 is closed, however, it should be realized that other types of hinges are possible including hinges that provide greater strength and robustness. The outer side of front exterior door 118 includes a plurality of bezels or covers each surrounding one or more openings in door 118 and a handle 130. A first bezel 121 (FIG. 1) surrounds a coin-in opening 122 and a coin-out opening 123. A second bezel 124 surrounds a bill-in opening 125 and a bill-out opening 126. A third bezel 127 surrounds a receipt opening 128. Handle 130 is located on the right side of door 118. The interior side of front exterior door 118 includes lock hardware 132, a coin chute 136 in communication with coin-in opening 122, a coin catch 138 in communication with coin-out opening 123 and, under one embodiment, a toe kick 140. Lock hardware 132 locks front exterior door 118 to cabinet 102 and allows front exterior door 118 to be unlocked using a key or the like. Toe kick 140 enhances the ergonomics of self-checkout system 100 by providing a recess for a guest's or customer's toes when using self-checkout system 100 while also protecting the internally located machines in cabinet 102. While toe kick 140 is illustrated as being mounted to a bottom of front exterior door 118, toe kick 140 may be mounted to other components of cabinet 102 including interior front door 120 or a pullout cartridge located inside cabinet 102 that will be discussed in detail below.

Figure 5:
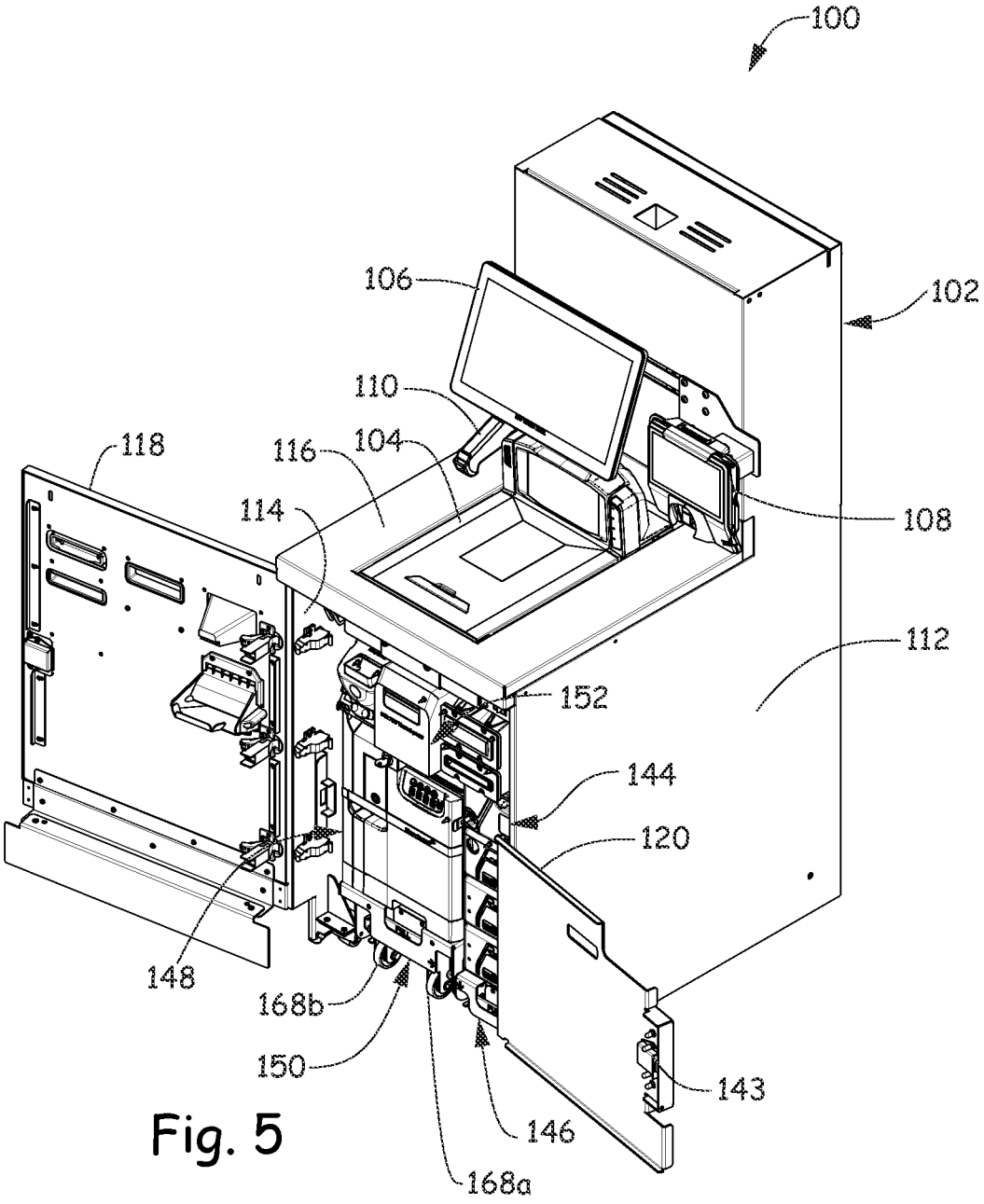
FIG. 5 illustrates a perspective view of the self-checkout system of FIG. 1 with the front exterior door and a front interior door of the cabinet opened.
Figure 6:
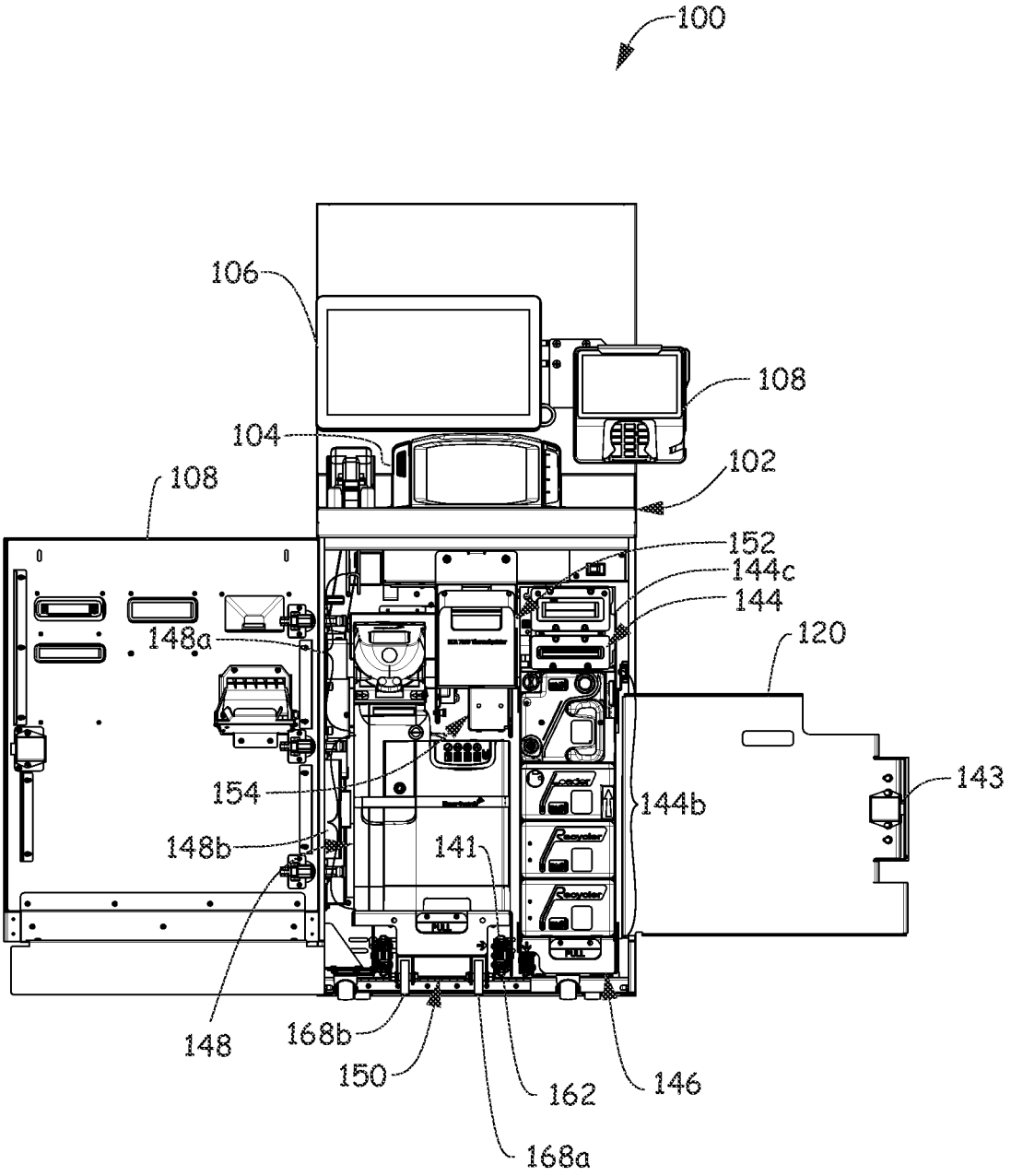
FIG. 6 illustrates a front view of FIG. 5.
Figure 7:
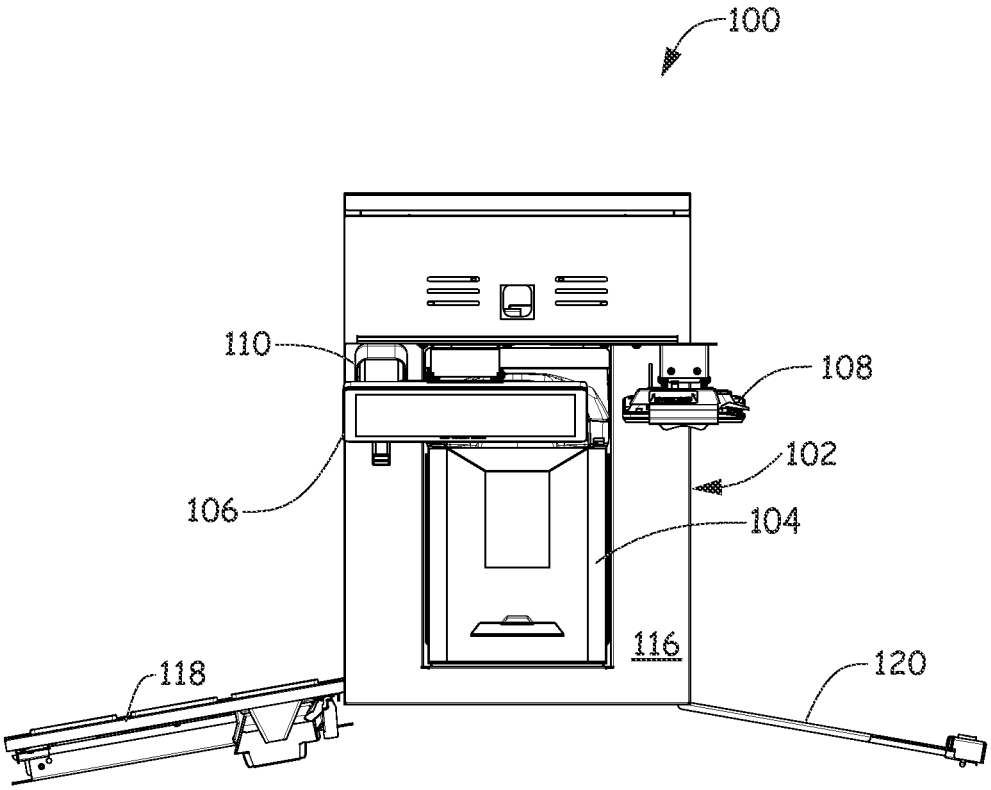
FIG. 7 illustrates a top view of FIG. 5.

FIG. 5 illustrates a perspective view of self-checkout system 100 with front exterior door 118 and front interior door 120 of 102 cabinet in opened positions or configurations. FIG. 6 illustrates a front view and FIG. 7 illustrates a top view of FIG. 5. As illustrated, front interior door 120 is located behind front exterior door 118 and is configured to cover a portion of the front opening of cabinet 102. While front interior door 120 is rotatably coupled to right side 112 by a hinge 142 (FIG. 3) or similar mechanism, front interior door 120 may be in the alternative rotatably coupled to left side 114. In other words, front interior door 120 is rotatably coupled to the other of right side 112 or left side 114 of cabinet 102 from that which front exterior door 118 is rotatably coupled. Front interior door 120 also includes lock hardware 143. In one embodiment, hinge 142 may be a piano hinge, however, it should be realized that other types of hinges are possible. Lock hardware 143 locks front interior door 120 to cabinet 102 and allows front interior door 120 to be unlocked using a key or the like. With both front exterior door 118 and front interior door 120 opened, the internally located machines of cabinet 102 are illustrated. The internal machines include, but are not limited to, a bill or note recycler 144, a coin recycler 148, a printer 152 and a power supply 154.

Bill recycler 144 includes a bill-in and bill-out sorting module 144*a* located above a stack of bill hoppers or cassettes 144*b* and supported by pullout cartridge 146. Likewise, coin recycler 148 includes a coin-in and coin-out sorting module 148*a* located above coin hoppers or cassettes 148*b* and supported by a pullout cartridge 150. Printer 152 is supported by a bracket and is located above power supply 154. Power supply 154 is supported by a bracket or one or more fins. With reference back to FIGS. 2 and 3, front interior door 120, when in a closed position or configuration, covers a portion of the front opening of cabinet 102 where bill hoppers or cassettes 144*b* of bill recycler 144, corresponding bill pullout cartridge 146, coin hoppers or cassettes 148*b* of coin recycler 148, corresponding coin pullout cartridge 150 and power supply 154, but leaves bill-in and bill-out sorting module 144*a* of bill recycler 144, coin-in and coin-out sorting module 148*a* of coin recycler 148 and printer 152 free.

As previously discussed, both bill recycler 144 and coin recycler 148 are supported by pullout cartridges 146 and 150, respectfully, so that these internal machines may be pulled out for maintenance including coin and bill collection and refilling. While pullout cartridges 146 and 150 may include the same type of pullout mechanism, for example, where the cartridge is attached to drawer slides and is operated by way of pull handles, in the embodiment of the illustrated self-checkout system 100, pullout cartridge 150 includes additional features that address the greater load of coin recycler 148 on pullout cartridge 150.

Figure 8:
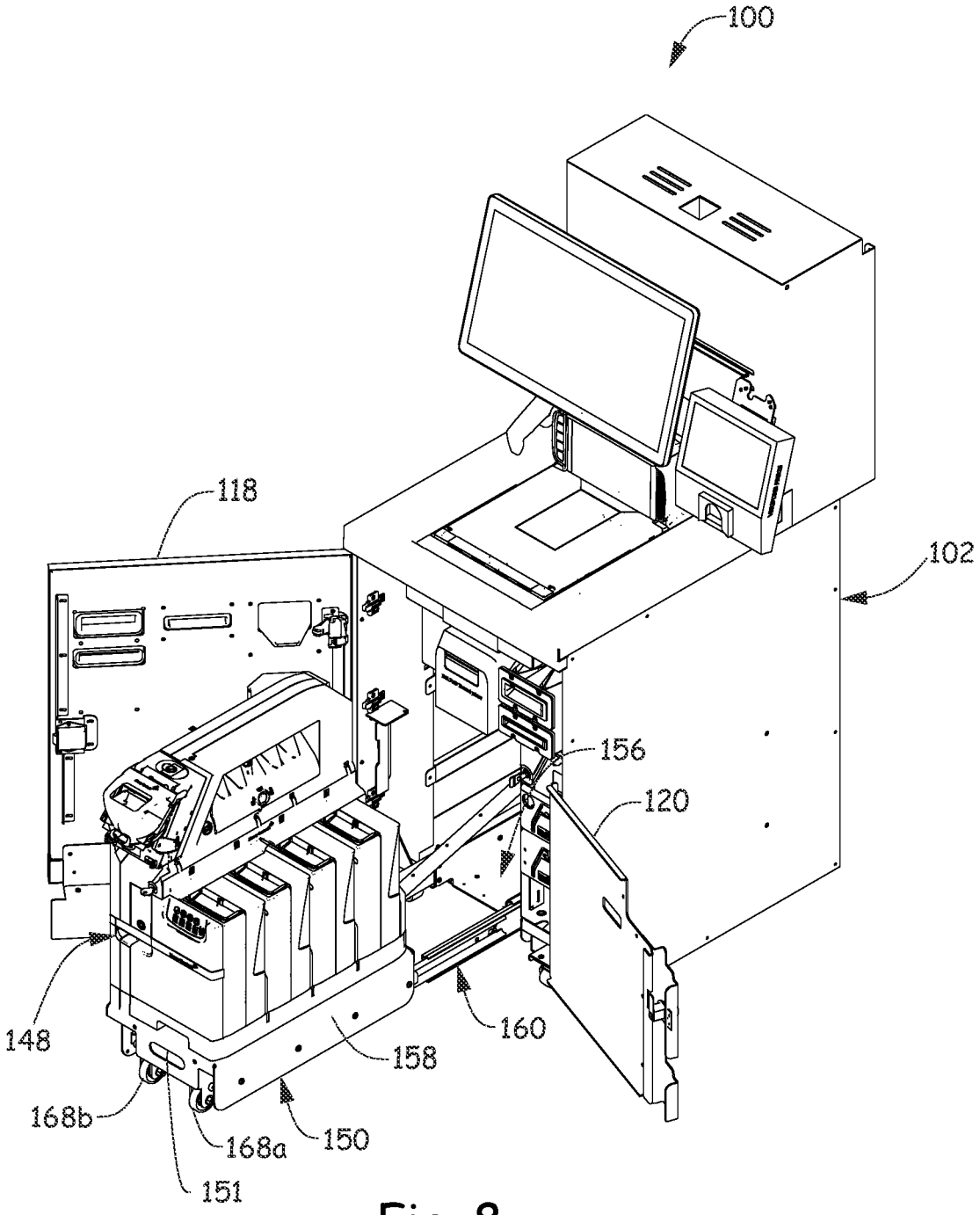
FIG. 8 illustrates a perspective view of the self-checkout system of FIG. 5 with a pullout cartridge supporting a coin machine pulled out from the cabinet.
Figure 9:
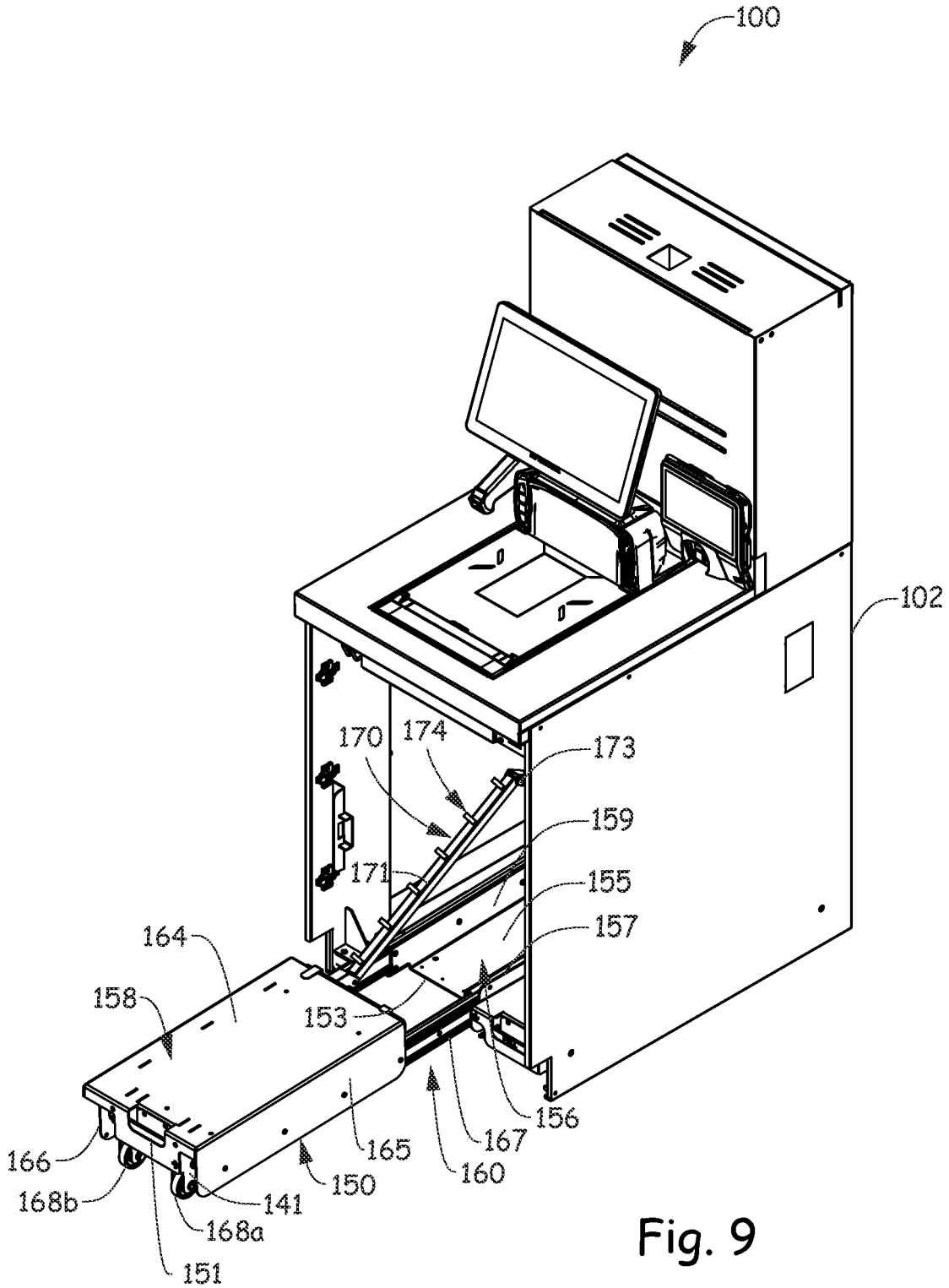
FIG. 9 illustrates a simplified perspective view of FIG. 8 with internal machines and doors removed.
Figure 10:
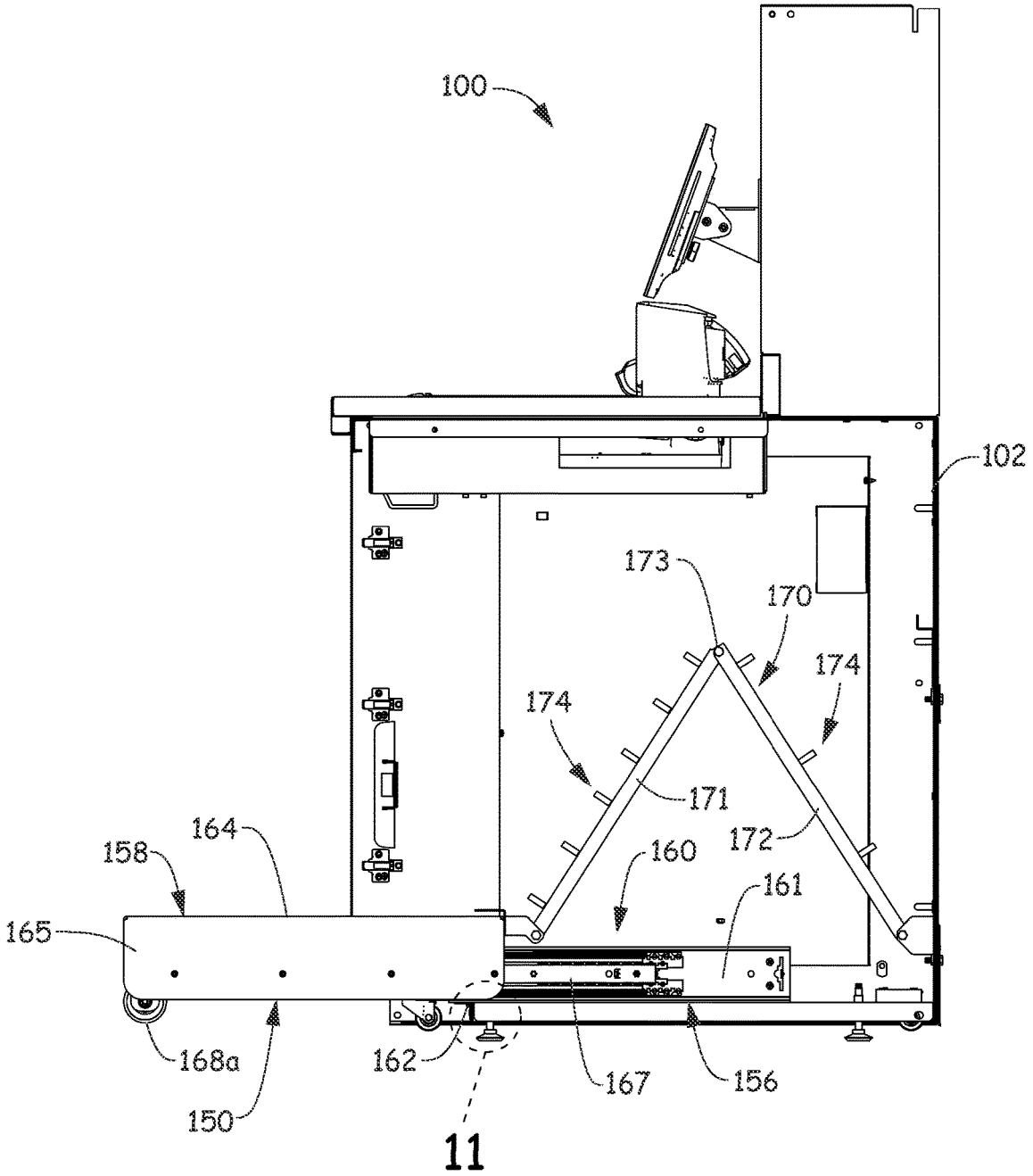
FIG. 10 is a simplified internal right side view of FIG. 9.
Figure 11:
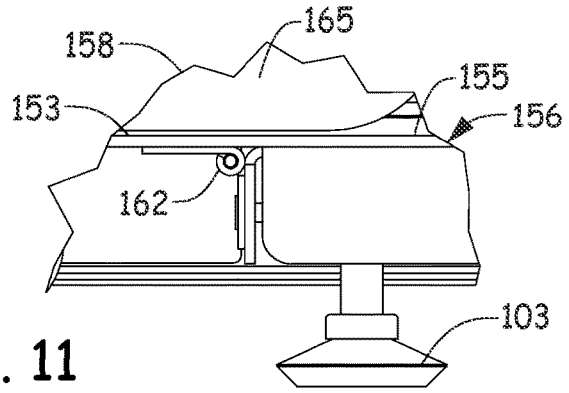
FIG. 11 illustrates an enlarged view of a portion of the self-checkout system indicated in FIG. 10.

FIG. 8 illustrates a perspective view of self-checkout system 100 in the opened door configuration illustrated in FIGS. 5-7 but with pullout cartridge 150 including coin recycler 148 being pulled out from cabinet 102. FIG. 9 illustrates a simplified perspective view of FIG. 8 with internal machines and doors 118 and 120 removed. FIG. 10 is a simplified internal right side view of FIG. 9. FIG. 11 illustrates an enlarged view of a portion of self-checkout system 100 indicated in FIG. 10. Pullout cartridge 150 is slidably coupled to a tilt body 156 that is located inside cabinet 102 with drawer slides 160. Pullout cartridge 150 includes a support body 158 having a front pull handle 151, a pair of wheels 168*a* and 168*b* and a latch 141.

Tilt body 156 is a U-shaped structure having a main panel 155 that connects right and left side panels 157 and 159. Right and left side panels 157 and 159 depend upwardly from main panel 155 and terminate at free edges. Rigidly attached to outer facing surfaces of each of the right and left sides panels 157 and 159 of tilt body 156 is a female profile component 161 of drawer slides 160. Coupled to an outer facing surface or bottom surface of main panel 155 is a tilt hinge 162 (see also FIGS. 3 and 6). As illustrated, tilt hinge 162 is attached to the outer facing surface or bottom surface of main panel 155 a spaced distance from a front edge 153 of tilt body 156.

Support body 158 includes a main panel 164 and right and left side panels 165 and 166. Right and left side panels 165 and 166 depend downwardly from main panel 164 and terminate at free edges. Main panel 164 receives and supports coin recycler 148. Rigidly attached to inner facing surfaces of each of the right and left side panels 165 and 166 of support body 158 is a male profile component 167 of drawer slides 160. Male profile components 167 mounted to support body 158 are configured to slidably mate with female profile components 161 mounted to tilt body 156 to form drawer slides 160. In one embodiment, drawer slides 160 are ball bearing slides that contain ball bearing components which enable the mated steel or steel alloy profile components to smoothly and quietly move relative to each other. While roller slides are also possible to use as drawer slides for pullout cartridge 150, ball bearing slides have greater load bearing capacities. Ball bearing slides may include progressive movement or telescopic slide movement. In progressive movement ball bearing slides, all slide components move simultaneously, which allows for smooth and quiet opening and closing motions. Telescopic slides are segmented and the movement of individual slide segment occur in stages, with each segment fully extending or condensing before propagating the motion of the next segment.

Pair of wheels 168*a* and 168*b* are coupled to and located at a front of support body 158 and below front pull handle 151. In one embodiment, wheel 168*a* may be coupled to right side panel 165 and wheel 168*b* may be coupled to left side panel 166. Latch 141 is located between right side panel 165 and wheel 168A and is configured to latch cartridge 150 inside cabinet 102 when cartridge 150 is in an unextended or stored configuration. Such an unextended or stored configuration will be discussed in detail below. Pullout cartridge 150 also includes a wire arm 170. Wire arm 170 includes a first link 171 having a first end and a second end and a second link 172 having a first end and a second end. The first end of first link 171 is pivotally coupled to a back of support body 158. The second end of first link 171 is pivotally coupled to the first end of second link 172 at a pivot point 173. The second end of second link 172 is pivotally coupled to a back of cabinet 102. Along each of first link 171 and second link 172 are a plurality of wire clips 174. Wire arm 170 provides structure for guiding one or more electrical wires connected to coin recycler 148 within cabinet 102 so that the one or more electrical wires are not pinched when pullout cartridge 150 is pulled out for access.

Figure 12:
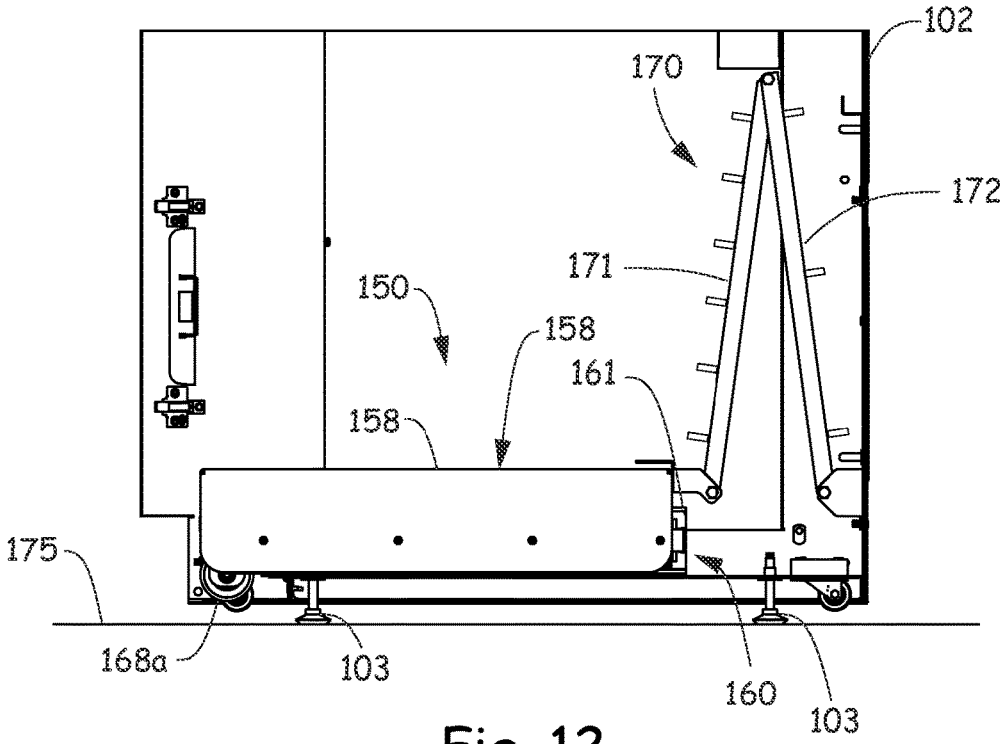
FIG. 12 illustrates a partial view of FIG. 10 with the pullout cartridge in an unextended configuration.

FIG. 12 illustrates a partial view of FIG. 10 with pullout cartridge 150 in an unextended or stored configuration. In an unextended or stored configuration, pullout cartridge 150 is fully recessed inside cabinet 102 and in a position where front interior and exterior doors 118 and 120 may be closed and locked. In this position or configuration, tilt body 156 is nested inside cartridge 150 and male profile components 167 are fully received by female profile components 161 of drawer slides 160. In addition, cartridge 150 is spaced apart from floor 175 so that wheels 168*a* and 168*b* hover above floor 175 because support body 158 is being supported by an untilted or balanced tilt body 156. Further, first and second links 171 and 172 of wire arm 170 are folded together and occupy a greater portion of a height of cabinet 102 rather than a depth of cabinet 102. Still further, in the unextended or stored configuration, latch 141 of carriage 150 is latched to tilt body 156.

Figure 13:
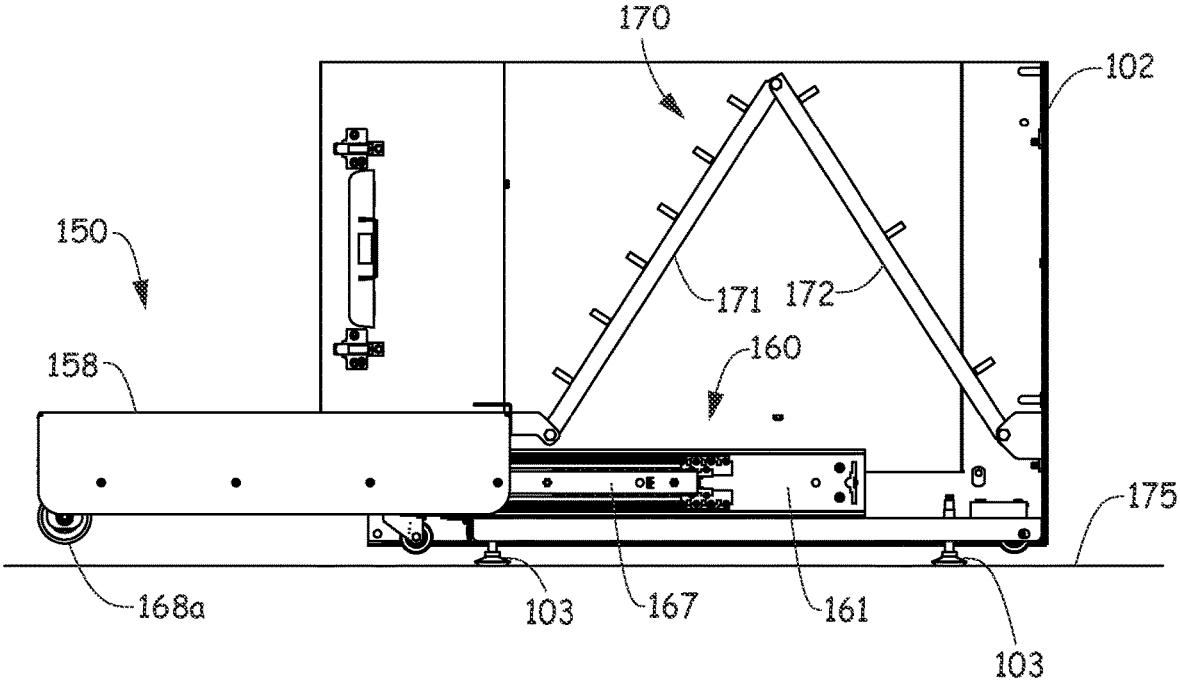
FIG. 13 illustrates a partial side view of FIG. 10 with the pullout cartridge in a partially extended configuration.

FIG. 13 illustrates a partial side view of FIG. 10 with pullout cartridge 150 in a partially extended configuration. To achieve this configuration or position, doors 118 and 120 were unlocked and opened, latch 141 was actuated to be released from tilt body 156 and pullout cartridge 150 is in the process of being extended so as to allow the coin recycler to be accessible for maintenance. Male profile components 167 are partially slid out of female profile components 161 of drawer slides 160. Support body 158 is still spaced apart from floor 175 and therefore wheels 168*a* and 168*b* still hover above floor 175 because support body 158 is not extended from tilt body 156 far enough to cause tilt body 156 to tilt. Further, first and second links 171 and 172 of wire arm 170 are partially unfolded to occupy a similar amount of the height and depth of cabinet 102.

Figure 14:
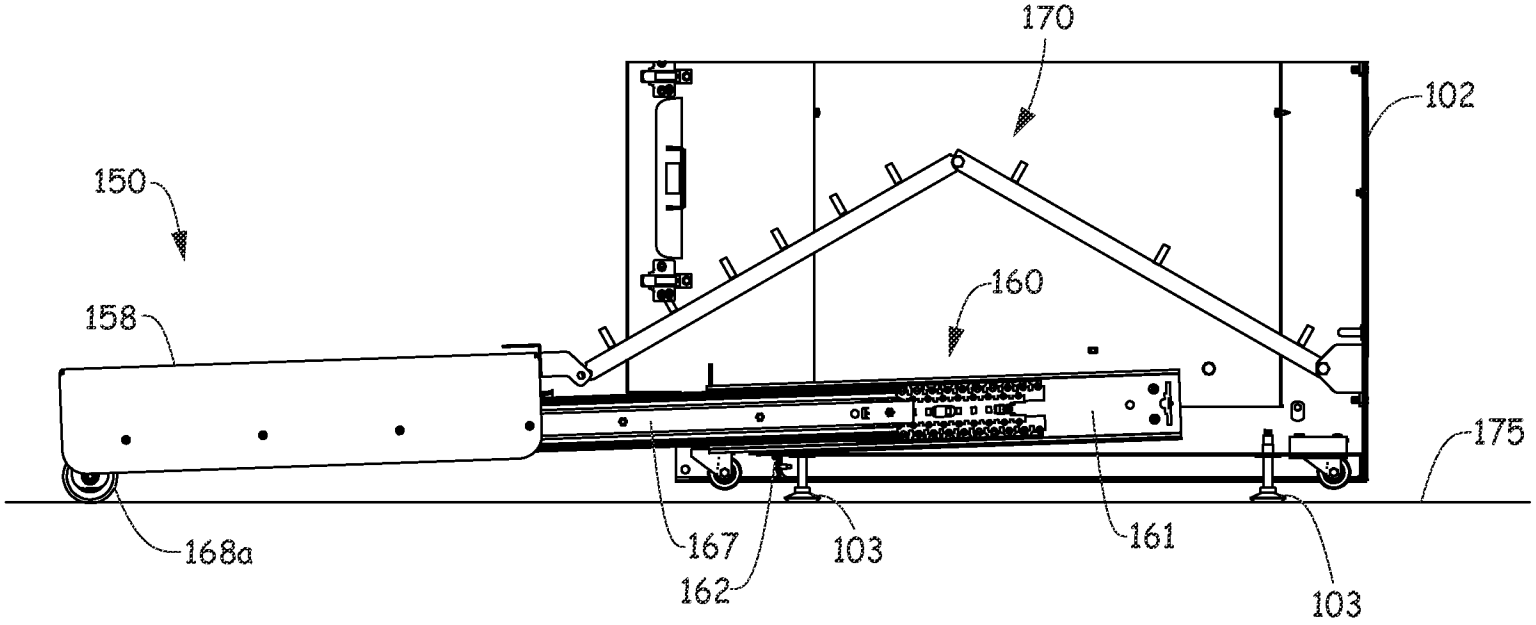
FIG. 14 illustrates a partial side view of FIG. 10 with the coin pullout cartridge in a fully extended configuration.

FIG. 14 illustrates a partial side view of FIG. 10 with pullout cartridge 150 in a fully extended or accessible configuration. In this position, pullout cartridge 150 is fully extended so as to access the coin recycler for maintenance. As illustrated, male profile components 167 are further slid out from female profile components 161 of drawer slides 160. Before full extension of support body 158 and at an extended or accessible configuration of pullout cartridge 150, the weight of support body 158 including the weight that is provided by coin recycler 148 causes tilt body 156 to tilt forwardly about tilt hinge 162 and lower support body 158 to engage with floor 175. As described above, tilt body 156 rigidly supports female profile components 161 of drawer slides 160 so drawer slides 160 are also tilted with tilt body 156. Upon tilt body 156 tilting forward, wheels 168*a* and 168*b* engage with floor 175. To reach the final extended or accessible configuration, wheels 168*a* and 168*b* roll support body 158 along floor 175 and bring pullout cartridge 150 into the fully extended or accessible configuration. First and second links 171 and 172 of wire arm 170 are unfolded to occupy a greater portion of the depth of cabinet 102 rather than the height of cabinet 102.

Figure 15:
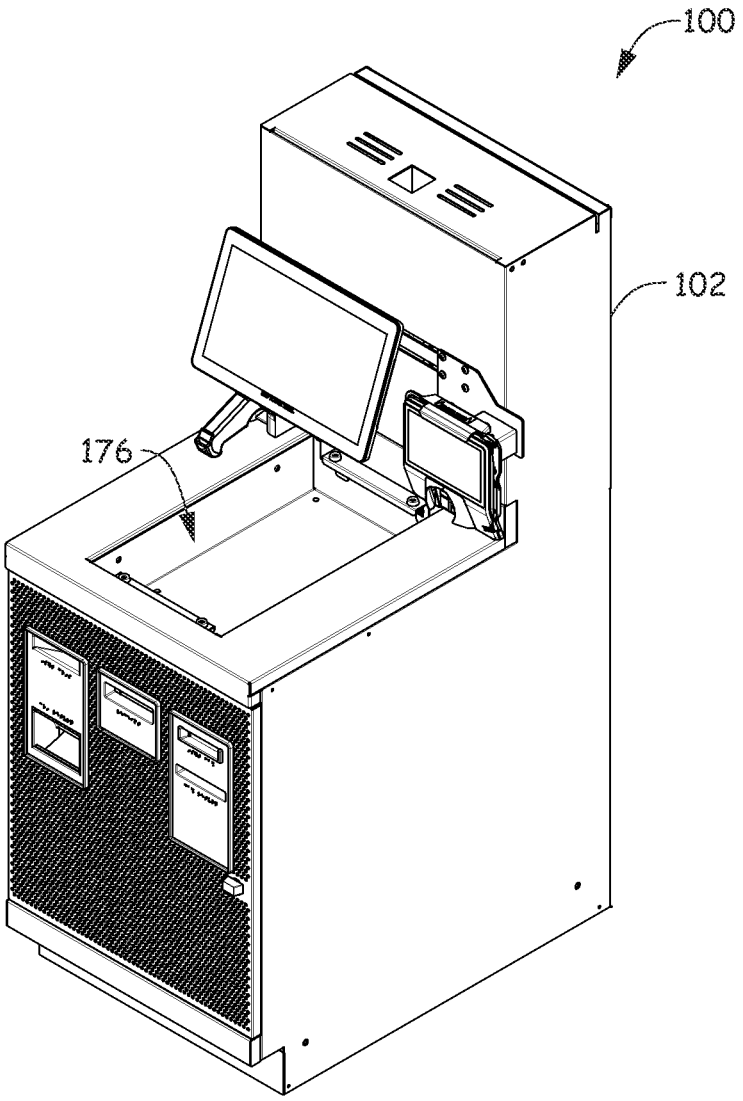
FIG. 15 illustrates a perspective view of the self-checkout system of FIG. 1 with a flatbed scanner removed to show a well.
Figure 16:
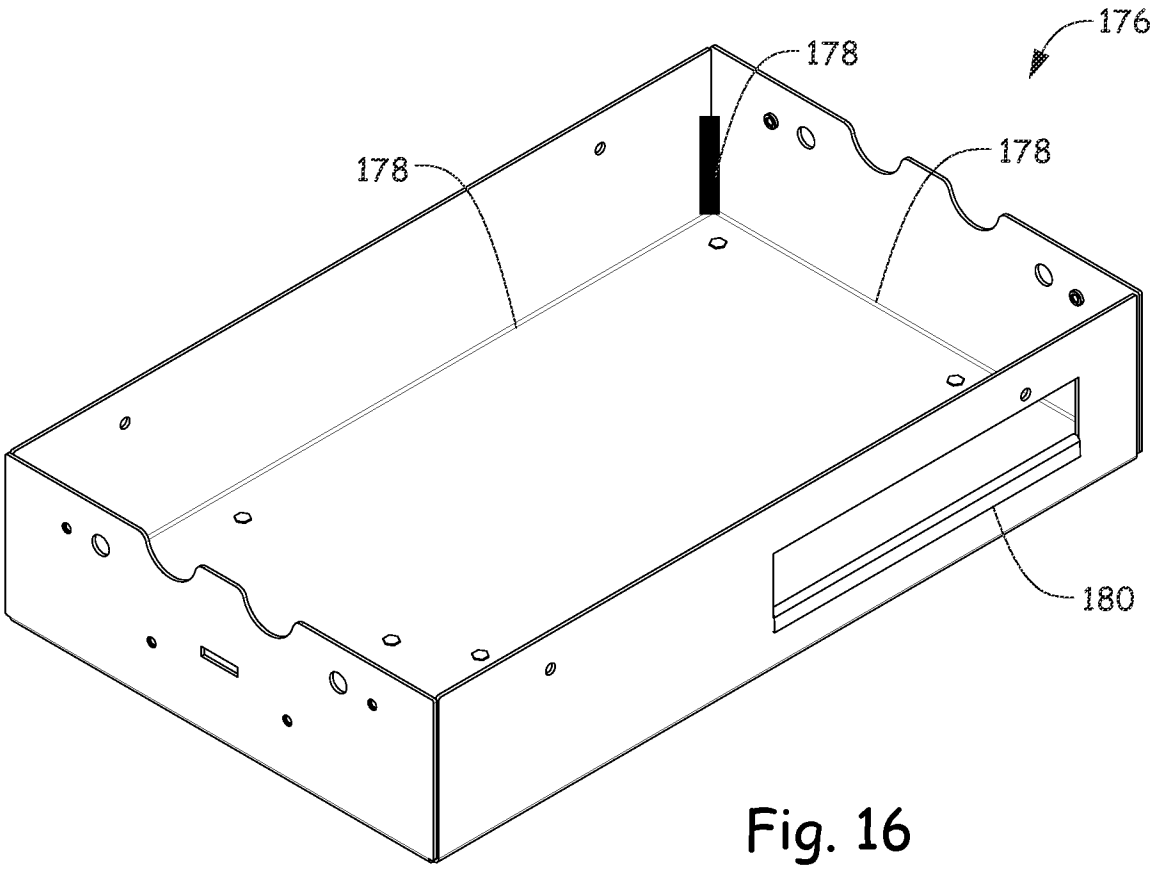
FIG. 16 illustrates a perspective view of the well in FIG. 15.

FIG. 15 illustrates a perspective view of the self-checkout system of FIG. 1 with flatbed scanner 104 removed to show a catch pan 176. FIG. 16 illustrates an enlarged perspective view of catch pan 176. Catch pan 176 is recessed from top 116 of cabinet 102 and located under flatbed scanner 104. Catch pan 176 is a structure that prevents liquid spills that occur on top 116 of cabinet 102 from reaching the internal machines inside cabinet 102. For example, food items are scanned on flatbed scanner 104. If liquid from a food item spills or leaks out onto top 116 it will spill into catch pan 176 rather than seep into the internal machines located below flatbed scanner 104 and well 176. While flatbed scanner 104 may be sacrificed in such an event, the internal machines, such as coin recycler 148, bill recycler 152, printer 152 and power supply 154 will be saved.

In one embodiment, catch pan 176 may hold up to a gallon of liquid and includes a bottom, four sides and fully welded seams 178 to prevent drainage. Catch pan 176 also includes an opening 180 along the height of well 176. Opening provides a window to a cubby for purposes of pass through wiring.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms for implementing the claims.

What is claimed is:

1. A self-checkout system comprising:

a cabinet supported by a floor and configured to support externally located machines and internally located machines;

a tilt body having a front end coupled to a hinge;

a cartridge including a pair of wheels and configured to support at least one of the internally located machines and configured to be positioned in an unextended configuration and an extended configuration; and drawer slides coupling the at least one cartridge to the tilt body;

wherein when the cartridge is in the unextended configuration the cartridge is located inside the cabinet and spaced apart from the floor and the tilt body is located completely inside the cabinet and is nested inside the cartridge; and wherein when the cartridge is in the extended configuration the cartridge is pulled out from the tilt body to a position at least partially outside the cabinet so that the pair of wheels of the cartridge engage with the floor and the tilt body pivots forward about the hinge and remains located completely inside the cabinet.

2. The self-checkout system of claim 1, wherein the cabinet comprises a right side, a left side, a top, a front exterior door rotatably coupled to the left side or the right side of the cabinet and a front interior door located behind the front exterior door and rotatably coupled to the other of the left side or the right side of the cabinet.

3. The self-checkout system of claim 2, wherein the front exterior door covers an entirety of a front opening of the cabinet and wherein the front interior door covers a portion of the front opening of the cabinet.

4. The self-checkout system of claim 1, wherein the tilt body comprises a right side panel, left side panel and a main panel connecting the right side panel to the left side panel, wherein the hinge is coupled to an outer facing surface of the main panel and female profile components of the drawer slides are mounted to the outer facing surfaces of the right side panel and the left side panel of the tilt body.

5. The self-checkout system of claim 1, wherein the cartridge comprises a support body having a right side panel, a left side panel and a main panel connecting the right side panel of the support body to the left side panel of the support body, wherein male profile components of the drawer slides are mounted to the inner facing surfaces of the right side panel and the left side panel of the support body.

6. The self-checkout system of claim 5, wherein the cartridge comprises a pull handle located on a front of the support body and a latch configured to latch the cartridge inside the cabinet when the cartridge is in an extended configuration.

7. The self-checkout system of claim 1, further comprising a wire arm pivotally coupling a back of the cartridge to an interior of the cabinet, wherein the wire arm includes at least two arm links having a plurality of wire clips for guiding wires from internal machines being supported on the cartridge to prevent pinching of the wires when moving the cartridge between the unextended and the extended configurations.

8. The self-checkout system of claim 1, further comprising a catch pan recessed from the top of the cabinet and located under one of the externally mounted machines, wherein the catch pan includes a bottom and four sides and is configured to keep liquid foodstuff spilled on the top of the cabinet from falling onto the internal machines inside the cabinet.

9. A self-checkout system comprising:

a cabinet supported by a floor;

a tilt body coupled to a hinge and located inside the cabinet; and a support body being slidably coupled to the tilt body, the support body comprising a pull handle located on a front of the support body and a latch configured to latch the support body inside the cabinet when the tilt body is balanced about the hinge;

wherein when the support body is located inside the cabinet the tilt body is balanced about the hinge and the support body is spaced apart from the floor; and wherein when the support body is pulled outside the cabinet a front of the tilt body is rotated about the hinge and the support body engages with the floor.

10. The self-checkout system of claim 9, wherein the cabinet comprises a right side, a left side, a top, a front exterior door rotatably coupled to the left side or the right side of the cabinet and a front interior door located behind the front exterior door and rotatably coupled to the other of the left side or the right side of the cabinet.

11. The self-checkout system of claim 9, wherein the hinge is coupled to an outer facing surface of a main panel of the tilt body.

12. The self-checkout system of claim 9, wherein the support body is slidably coupled to the tilt body by a pair of drawer slides.

13. The self-checkout system of claim 12, wherein female profile components of the drawer slides are coupled to outer facing surfaces of the tilt body.

14. The self-checkout system of claim 13, wherein male profile components of the drawer slides are mounted to the interior surfaces of the support body.

15. The self-checkout system of claim 9, further comprising a catch pan recessed from a top of the cabinet, wherein the catch pan includes a bottom and four sides and is configured to keep liquid foodstuff spilled on the top of the cabinet from falling onto internal machines being supported by the support body.

16. A self-checkout system comprising:

a cabinet having at least one front door and configured to be supported by a floor;

a tilt body being rotatably coupled to a hinge; and a pullout cartridge slidably coupled to the tilt body and being located inside of and latched to the tilt body in a stored configuration and being located outside of and unlatched from the tilt body in an accessible configuration;

wherein in the stored configuration the at least one front door is closed, the pullout cartridge is located inside the cabinet and spaced apart from the floor and the tilt body is located completely inside the cabinet and is nested inside the pullout cartridge; and wherein in the accessible configuration the at least one front door is opened, the pullout cartridge is positioned to be at least partially located outside the cabinet and engaged with the floor and the tilt body is rotated forward about the hinge and remains completely inside the cabinet.

17. The self-checkout system of claim 16, wherein the at least one door comprises a front exterior door rotatably coupled to a left side or a right side of the cabinet and a front interior door located behind the front exterior door and rotatably coupled to the other of the left side or the right side of the cabinet.

18. The self-checkout system of claim 16, wherein the hinge is coupled to an outer facing surface of a main panel of the tilt body.

19. The self-checkout system of claim 16, wherein the support body is slidably coupled to the tilt body by a pair of drawer slides.

* * * * *